United States Patent [19]

Rantanen et al.

[11] Patent Number: 4,981,726

[45] Date of Patent: Jan. 1, 1991

[54] METHOD AND APPARATUS FOR DISPENSING COATING MATERIALS ON A MOVING SUBSTRATE WITH A SMOOTHING MEMBER AND SUPPORTING STRUCTURE

[75] Inventors: Rauno Rantanen, Muurame; Markku Lummila, Jyväskylä, both of Finland

[73] Assignee: Valmet Paper Machinery Inc., Finland

[21] Appl. No.: 227,693

[22] Filed: Aug. 3, 1988

[30] Foreign Application Priority Data

Aug. 4, 1987 [FI] Finland ..... 873376

[51] Int. Cl.[5] ..... B05D 3/12

[52] U.S. Cl. ..... 427/356; 118/119; 118/691

[58] Field of Search ..... 118/665, 690, 691, 119; 427/356, 358, 391, 395

[56] References Cited

U.S. PATENT DOCUMENTS

| | | | |
|---|---|---|---|
| 2,946,307 | 7/1960 | Warner | 118/119 |
| 2,970,564 | 2/1961 | Warner | 118/227 X |
| 3,084,663 | 4/1963 | Warner | 118/119 X |
| 3,179,083 | 4/1965 | Warner | 118/119 |
| 3,304,910 | 2/1967 | Warner | 427/356 X |
| 3,312,191 | 4/1967 | Lowe | 118/119 X |
| 4,357,370 | 11/1982 | Alheid | 118/206 X |
| 4,738,877 | 4/1988 | Krautzberger | 118/123 X |

*Primary Examiner*—Shrive Beck
*Assistant Examiner*—Alain Bashore
*Attorney, Agent, or Firm*—Steinberg & Raskin

[57] ABSTRACT

Method and apparatus for dispensing coating material on a moving substrate, such as a paper or cardboard web or the surface of a roll or the like, wherein the coating material is introduced into the coating apparatus before a coating nip and applied to the substrate through a slit of the coating apparatus directly onto the surface of the moving substrate. The coating nip and slit of the coating apparatus are formed so that a coating material smoothing member of the coating apparatus is directly supported against the moving substrate in a manner such that the free flow aperture of the slit at the coating nip is confined by the moving substrate and the surface of the smoothing member.

7 Claims, 3 Drawing Sheets

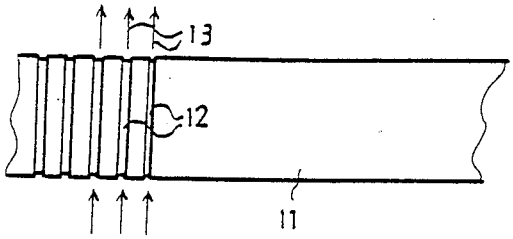
FIG. 4
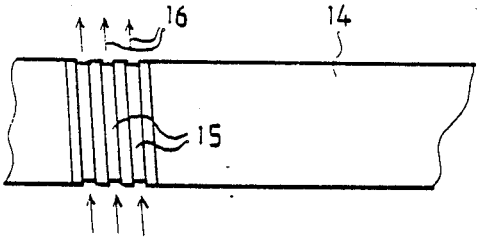
FIG. 5
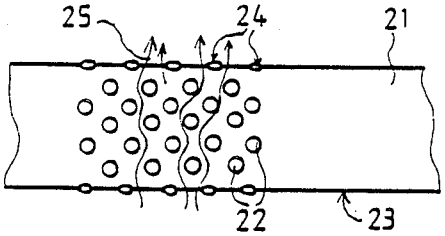
FIG. 6A
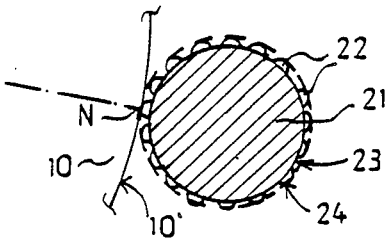
FIG. 6B
FIG. 7A
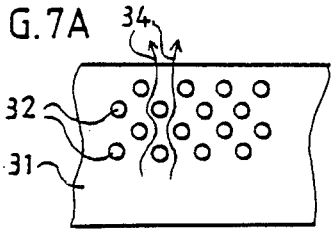
FIG. 7B
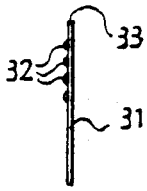
FIG. 7C
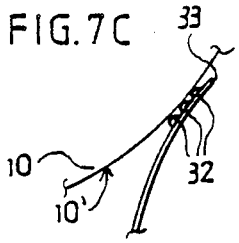

METHOD AND APPARATUS FOR DISPENSING COATING MATERIALS ON A MOVING SUBSTRATE WITH A SMOOTHING MEMBER AND SUPPORTING STRUCTURE

BACKGROUND OF THE INVENTION

The present invention relates generally to methods and apparatus for dispensing coating material on a moving substrate.

The method and apparatus of the invention may be applied in the coating of a paper or cardboard web in which case the invention relates to a coating arrangement for use in paper making. The invention may also be applied in the dispensing of coating material on the surface of a roll, such as in a sizing press, from which the coating material is then transferred, in a throat between press rolls, onto a paper or cardboard web passing through the sizing press. In this case, the invention relates to sizing press arrangements used in paper making.

More particularly, the invention relates to methods and apparatus for dispensing coating material on a moving substrate in which coating material is introduced under pressure into coating apparatus before the coating nip and wherein the coating material is directly applied on the surface of the moving substrate through a slit nozzle provided in the nip.

A known arrangement for dispensing coating material on a moving substrate uses the so-called doctor coating method. Due to its numerous advantages, the doctor coating method is practically the only coating procedure being used, particularly in high-speed coating machines. One of the most important advantages of this method is that a smooth paper (or cardboard) surface is obtained which is very important for obtaining a finished product having good printing characteristics.

In the doctor coating method, an excess quantity of coating material is introduced on the paper web which is supported by a rotating roll whereupon an elastic doctor blade disposed against the web functions to scrape off a portion of the coating material on the web surface in order to leave a desired quantity of coating material on the web in the form of a uniform layer. The portion of the coating material which is scraped off by the doctor is saved and subsequently reintroduced into the coating apparatus.

The main drawback of the doctor coating method is the difficulty in controlling the quantity of the coating material being applied on the substrate, e.g. the web. This is a result of the fact that several factors influence the quantity of coating material that is applied on the web, namely, the rheologic properties of the coating material, the geometric orientation of the coating doctor with respect to the web being coated, i.e., the so-called doctor angle, and the loading of the coating doctor, i.e., the pressure applied by the doctor on the web.

Since it is important to return the portion of the coating material which is scraped off by the doctor to the supply of fresh coating material being applied to the web in order to avoid loss of coating material, the coating material must have good flow properties. On the other hand, this necessarily makes it difficult to increase the dry matter content of the coating material which should be relatively high in order to yield a high quality coating. For example, migration of the bonding agent in the coating will be reduced when the coating material has a high dry matter content. Moreover, since a paper web must be conducted through drying apparatus subsequent to the coating operation in order to remove moisture from the web, a high dry matter content of the coating material is also advantageous from the viewpoint of energy efficiency.

Two different doctor coating methods are generally employed in coating paper or cardboard which essentially differ from each other with respect to the angle which the coating doctor forms with the opposing web roll being coating. In the so-called low-angle coating method, the angle between the doctor and an opposing web roll is only a few degrees. On the other hand, in the so-called high-angle coating arrangement, the angle which the doctor forms with an opposing web roll is generally several tens of degrees.

The low-angle coating arrangement for coating a cardboard web is advantageous in that it provides a coating layer having relatively uniform thickness which is important, for example, to ensure uniform absorption of printer's ink. Further, any impurities present in the coating material and/or the cardboard web will by-pass the doctor without adhering to it thereby avoiding the formation of doctor stripes or streaks.

On the other hand, the low-angle technique has the drawback that it is difficult to control the coating material quantity since the amount of coating material deposited on the web changes significantly when the relatively small angle between the doctor and the surface of the opposing roll is changed even minimally in order to regulate the coating quantity.

On the other hand, the high-angle coating arrangement is advantageous when small quantities of coating material are being applied, such as less than about 12 $g/m^2$, in that relatively good coating material quantity control can be achieved. On the other hand, it is difficult to control coating material quantities when larger coating material quantities are being applied since the doctor will initially merely fill the irregularities in the web.

The most significant drawback of the arrangement wherein a coating is applied onto a surface of a roll in a sizing press for transfer onto a paper or cardboard web is that production rates are limited and the range of viscosity of the sizing agents which can be employed are also limited.

Another known arrangement for coating paper and cardboard is the extruder technique in which coating material is introduced onto the web by passing the coating material through a slit under pressure as the web passes by the slit. In this arrangement, the quantity of coating material dispensed onto the web is determined by the volumetric flow rate of the coating material supplied to the slit.

The main drawback of this conventional technique is that the coating quantity profile cannot be precisely adjusted since the distance of the scraping wall of the slit from the web cannot be locally adjusted. For example, if the opposing roll surface has irregularities in its profile due, for example, to wear, a poor coating quantity profile will result. In mineral pigment coating, the fixed scraper wall undergoes rapid wear. However, the replacement of this precision machined, relatively massive wall would require unreasonable expenditures.

Regarding the state of the art, reference is made to U.S. Pat. Nos. 2,946,307, 2,970,564 and 4,357,370. Briefly, an arrangement is disclosed in U.S. Pat. No. 2,946,307 in which a roll surface or a gate roll over which one surface of a paper web runs is coated using a steel rod while the other web surface is coated using a steel rod which at the same time presses the coating from the roll onto the contacting surface of the paper web. U.S. Pat. No. 4,357,370 discloses an arrangement wherein a roll surface is coated using a suitable applicator while the non-contacting side of the paper web is coated using a short delay doctor.

SUMMARY OF THE INVENTION

Accordingly, it is an object of the present invention to provide new and improved methods and apparatus for dispensing coating material on a moving substrate.

Another object of the present invention is to provide new and improved methods and apparatus for dispensing coating material onto a moving substrate in which the drawbacks of conventional coating arrangements discussed above are avoided.

Still another object of the present invention is to provide new and improved methods and apparatus for dispensing coating material on a moving substrate which can be employed in surface sizing techniques using extruder coating, doctor coating, and rolls.

Briefly, in accordance with the method of the present invention, these and other objects are attained by providing an arrangement wherein the coating nip and slit of the coating means are formed such that a coating material smoothing member of the coating means is directly supported on the moving substrate so that the free flow aperture of the slit nozzle is defined, at the coating nip, by the moving substrate and by the surface of the smoothing member.

In accordance with the apparatus of the invention, these and other objects are attained by providing coating material dispensing apparatus including a slit for dispensing the coating material, which slit is defined on the one hand by the moving substrate, and on the other hand, by a smoothing member which is directly supported on the moving substrate by a supporting structure integrally connected thereto or forming part thereof.

The method and apparatus of the invention can be used in various coating applications including those discussed below.

Firstly, the method and apparatus of the invention are applicable in standard doctor coating techniques in which the coating material is brushed on the web lying against an opposing roll. One of the advantages of this arrangement is that no coating material recirculation is required since no extra coating material is supplied to the web. Additionally, neither the location of the coating doctor with respect to the substrate nor the loading of the doctor has any material effect on the coating deposited on the web. Additionally, the properties of the coating material have little effect on the coating quantity thereby enabling several different types of coating materials to be used in the practice of the invention. Since the web is not in contact with any excess coating material in the method and apparatus of the invention, the web will not absorb any excess water from the coating material. The apparatus of the invention will be situated with respect to the web in any particular geometry dictated solely by convenience for any particular application.

The method and apparatus of the invention may also be applied in sizing press coating applications, in which coatings of different materials from different extruders may be applied on the rolls of the sizing press from which the coating material is transferred onto the web surfaces as the web passes through the throat between the rolls. The arrangement of the invention will avoid splashing of the sizing material common in conventional sizing press arrangements in which the coating material is situated in pools between the rolls. An accurate control of the coating quantity is achieved utilizing the arrangement of the invention. The invention also makes it possible to select the material from which the sizing press rolls are formed such that the coating material barely wets the rolls and such that the coating material is readily detached from the surfaces of the rolls and transferred to the surface of the web. In this manner, the coating material will not accumulate on the roll surfaces thereby resulting in improved uniformity of the web coating.

The arrangement of the invention is also applicable in two-sided doctor coating of a web in which the web passes between two separate extruders facing each other. The invention may also be applied in two-sided web coating techniques of the type disclosed in the above-mentioned U.S. Pat. No. 4,357,370. In this design, the coating material is applied on a surface of an opposing roll by first coating means from which it is further transferred to the web surface passing over the roll. The coating material is applied directly on the opposite side of the web passing over the opposing roll by second coating means.

DESCRIPTION OF THE DRAWINGS

A more complete appreciation of the present invention and many of the attendant advantages thereof will be readily understood by reference to the following detailed description when considered in connection with the accompanying drawings which illustrate preferred embodiments of the invention and wherein:

FIGS. 4 and 5 are partial views of different coating rods provided with grooves for use in arrangements in accordance with the invention;

FIG. 6A is a partial view of a coating rod provided with protuberances for use in arrangements in accordance with the invention;

FIG. 6B is a transverse section view of the coating rod shown in FIG. 6A in cooperation with a roll surface in accordance with the invention;

FIGS. 7A, 7B, and 7C are schematic illustrations of a coating doctor provided with protuberances which may also be used in arrangements in accordance with the invention.

DESCRIPTION OF THE PREFERRED EMBODIMENTS

Figure 1A:
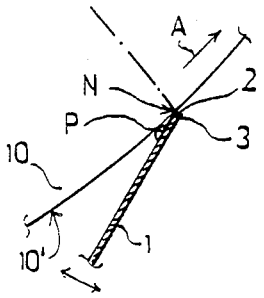
FIGS. 1A and 1B are schematic illustrations of an arrangement in accordance with the invention wherein a coating doctor disposed against an opposing roll defines a slit nozzle, FIG. 1A showing the arrangement in elevation and FIG. 1B showing the arrangement in a partially sectioned perspective view.
Figure 1B:
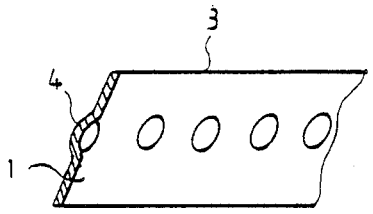

Referring now to the drawings wherein like reference characters designate identical or corresponding parts throughout the several views, and more particularly to FIGS. 1A and 1B, an arrangement in accordance with the invention includes a smoothing member in the form of a coating doctor 1 and an opposed roll 10 rotating in the direction of arrow A, the doctor 1 and roll 10 together defining a slit 2 at a coating nip N. Other conventional components of the coating apparatus, such as means for conducting the coating material to the slit 2, are not shown for purposes of clarity. The slit 2 is defined by the tip 3 of the coating doctor 1 and the surface 10' of the opposing roll 10. In the embodiment of FIGS. 1A and 1B, protuberances 4 are formed in the coating doctor in a row extending in the cross-machine direction proximate to the tip 3 of the coating doctor. The protuberances 4 are situated against the surface 10' of the roll 10 to thereby constitute a supporting structure for the doctor and are preferably formed on the coating doctor prior to quenching. The protuberances 4 are spaced from each other in the transverse direction of the coating doctor 1 with relatively wide spacing between them and lie against the surface 10' of roll 10. The apices of the protuberances 4 serve as points or a region of support P for the coating doctor 1. Thus, in this embodiment of the invention the size of the slit nozzle 2, and therefore the quantity of coating material dispensed onto the surface 10', may be regulated by adjusting the angle of the coating doctor 1 with respect to the surface 10' by pivoting the coating doctor 1 with the point or region P as a fulcrum. Since the protuberances 4 which constitute the supporting structure are relatively widely spaced from each other, they do not substantially impede the flow of coating material through the free flow aperture of the slit nozzle. The arrangement of the invention provides a uniform longitudinal as well as transversal coating material quantity profile.

Figure 2A:
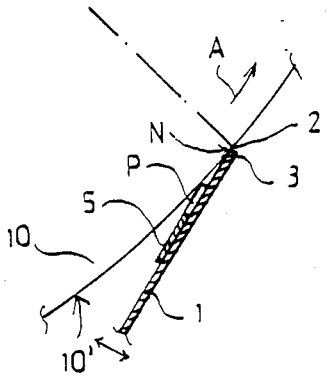
FIGS. 2A and 2B are views similar to FIGS. 1A and 1B illustrating another embodiment of an arrangement in accordance with the invention.
Figure 2B:
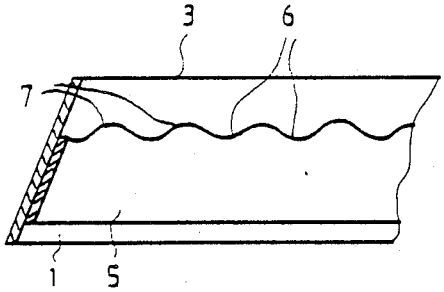

Referring now to FIGS. 2A and 2B, an alternate embodiment to the one illustrated in FIGS. 1A and 1B is illustrated. Like the embodiment of FIGS. 1A and 1B, a slit 2 of the coating apparatus is defined by the tip 3 of a smoothing member in the form of a coating doctor 1 and the surface 10' of an opposing roll 10. The embodiment of FIGS. 2A and 2B differs from that of FIGS. 1A and 1B in that the supporting structure of the coating doctor 1 which is supported against the surface of the opposing roll comprises a separate supporting blade 5 attached to the coating doctor 1. The tip of the supporting blade 5 is provided with undulating notches 6 and alternating ridges 7. The ridges 7 are disposed against the surface 10' of the opposing roll 10 and constitute a fulcrum point or region P about which the coating doctor 1 can be pivoted to adjust the size of the slit nozzle 2. The coating material is dispensed through the free flow aperture of the slit 2 after passing through the notches 6 formed between the ridges 7.

Figure 3:
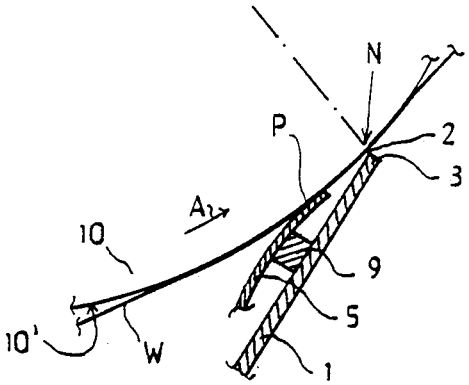
FIG. 3 is a schematic elevation view in section illustrating a third embodiment of an arrangement in accordance with the invention.

A potential problem which may occur in the operation of the embodiment of the FIGS. 2A and 2B is the wear of the supporting blade 5. Undue wear may be avoided, however, by disposing the supporting blade 5 such, that it forms a relatively small angle, for example, approaching zero degrees, with respect to the surface 10' of roll 10. Referring to FIG. 3, such positioning is faciliated by providing a wedge 9 or the like between the supporting blade 5 and the coating doctor 1 to separate at least the tip portion of the supporting blade 5 from the coating doctor to thereby make it possible to adjust the angle between the supporting blade 5 and the roll surface 10, to be sufficiently small.

Although the embodiments of the invention illustrated in FIGS. 1–3 are applicable in any roll coating construction known in the art, they are most appropriate for use in low-angle doctor coating arrangements. These embodiments have the advantage, among others, of avoiding cavitation phenomena which might otherwise damage the coating layer, such as when a helical coating rod is used. Another advantage, particularly useful in pigment coating carried out using a helical coating rod, is that the coating doctor of the invention will smooth out the "helix marking" which may be formed in viscous coating material when a helical coating rod is used.

The embodiments illustrated in FIGS. 2–3 may also be modified by locating the supporting blade 5 at the very tip of the coating doctor 1. In this case, the coating doctor operates in the same manner as a helical coating rod and all of the advantages described above will not necessarily be attained. For example, the "helix marking" may be visible in the coating. Furthermore, the arrangement of the invention may be employed in the application of coating material directly onto the surface of a web W as shown in FIG. 3. The web W may, for example, comprise a paper or cardboard web or the like. All of the advantages described above are obtained in direct coating of the web.

Referring now to FIGS. 4–6, alternative embodiments of the invention are illustrated wherein the slit nozzle is defined by the moving substrate, such as the surface of a roll, a paper web or the like, and a coating rod. Specifically, a rod 11 is illustrated in FIG. 4 which is provide with peripheral grooves 12. A rod 14 provided with helical grooves 15 is illustrated in FIG. 5. In each case, the coating material will flow through the individual apertures defined by the grooves 12,15 and the moving substrate. However, both embodiments have the drawback that when the grooved rod 11,14 is used, stripes, designated 13,16 which are parallel to grooves 12,15, will appear in the coating, particularly when viscous coating materials are used. If such a grooved roll 11,14 is used in a sizing press application, the sizing press will be unable to smooth out the markings that have appeared in the coating.

Referring now to FIGS. 6A and 6B, a coating rod embodiment of the invention is illustrated which provides improved operation with respect to the embodiments illustrated in FIGS. 4 and 5 in that any stripes or streaks formed in the coating will be smoothed out. In particular, the surface of a smoothing member in the form of a coating rod 21 is provided with a supporting structure in the form of protuberances 22 having small dimensions both in the peripheral as well as in the axial direction of the coating rod 21. However, the height of the protuberances 22 and, accordingly, the depth of the "grooves" or spaces formed between them, is relatively large. The protuberances 22 are located on the surface of coating rod 21 in a manner such that no adjacent protuberances are aligned in the peripheral direction of the coating rod 21. Thus, the "grooves" or spaces defined between the protuberances 21 and the moving substrate will be offset from the peripheral or circumferential direction of the rod, i.e. will be crooked. As seen in FIG. 6B, the coating rod 21 is carried on a moving substrate such as the surface 10' of an opposing roll 10, and is directly supported thereon by the outer surfaces or apices 24 of the protuberances 22. A slit-type is therefore composed of the "grooves" or spaces which are defined between protuberances 22, which extend between the surface 10' of the opposing roll 10 on the one hand and the surface 23 of the coating rod 21 on the other hand.

The embodiment of FIGS. 6A and 6B has the advantage that the flow paths of the coating material between the protuberances 22 are convoluted, the protuberances 22 also causing a transverse flow component indicated by arrows 25 in FIG. 6A. This results in a smoothing out of the stripes marking or streaks caused by individual protuberances 22. This arrangement also enables the quantity of coating material utilized in the coating operation to be minimized since the area occupied by the protuberances 22 may account for a relatively high proportion of the total area of the coating rod 21. This in return results in a more uniform coating and reduced cavitation.

FIGS. 7A–7C are schematic illustrations of a coating doctor 31 having a surface provided with protuberances 32 in a pattern similar to the embodiment of FIGS. 6A and 6B. The coating doctor 31 is illustrated in a planar projection in FIGS. 7A. An elevational view of the coating doctor 31 is illustrated in FIG. 7B. The coating doctor 31 is shown in operating position with respect to the surface 10' of an opposing roll 10 in FIG. 7C.

The coating doctor 31 is thus provided with protuberances 32 similar in construction and pattern to the protuberances 22 shown in FIGS. 6A and 6B. The protuberances 32 maintain a distance between the tip 33 of the coating doctor and the substrate to be coated, e.g., the surface 10' of the opposing rolls. As in the case of the embodiment of FIGS. 6A and 6B, the protuberances 32 provided on the coating doctor 31 are positioned so that no adjacent protuberances are aligned in the longitudinal direction of the doctor. The flow of coating material is thereby convoluted and the protuberances 32 cause similar transversal flows as in the case of the embodiment of FIGS. 6A and 6B. The embodiment of FIGS. 7A–7C may be applied, for example, on the coating doctor 1 shown in FIGS. 1A and 1B or on the supporting blade 5 of FIGS. 2A–3. The protuberances 32 may be formed on the coating doctor 31 in a manner similar to the manner in which the protuberances 4 of FIGS. 1A and 1B or 24 of FIGS. 6A and 6B are formed, in any suitable manner, preferably prior to quenching the coating doctor 31. The protuberances 22 of the coating rod of FIGS. 6A and 6B may be produced, for example, by knurling.

Figure 8:
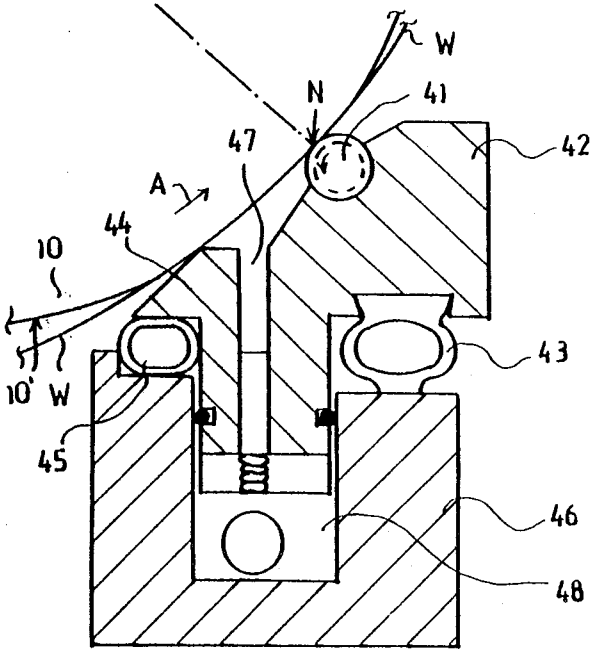

Referring now to FIG. 8, a schematic, partly sectioned, elevational view of an extruder-type coating apparatus is illustrated. The apparatus comprises a smoothing member in the form of a coating rod 41 which may, for example, be constructed in accordance with any one of the embodiments described herein, such as similar to the construction illustrated in FIGS. 6A and 6B where protuberances of the coating rod are directly supported against the surface 10' of the opposing roll 10 or against the web W. Thus, the slit nozzle provided at the coating nip N is defined by the space between the surface 10' of the opposing roll or the web W on the one hand, and by the "grooves" or spaces defined between the protuberances on the other hand. The coating rod 41 is mounted in a rod holder 42 in which it is rotated, advantageously in the same direction as the direction of rotation A of opposing roll 10. In this case, the directions in which the surface 10' of the roll 10 and the periphery of the coating rod 41 rotate are opposed at their points of contact. As shown in FIG. 8, the coating rod holder 42 and forward edge 44 of the coating means are advantageously formed in an integral manner and are both adjustably supported on the frame 46 of the coating apparatus by means of loading tubes 43 and 45. Loading tube 43 is used to regulate the pressure of the coating rod 41 against the moving substrate, e.g. the surface 10' of opposing roll 10, or web W. The loading tube 45 is used to regulate the sealing of the forward edge 44 against the moving substrate. In the frame 46 of the coating apparatus, a coating material chamber 48 is formed into which coating material is supplied. The coating material is conducted from the coating material chamber 48 through a passage 47 onto the moving substrate. Coating material is supplied into the coating material chamber 48 at a substantially constant volumetric feed rate, and the pressure of the coating material in chamber 48 is measured. The pressure exerted by the coating rod 41 against the moving substrate is adjusted to a suitable level so that the pressure in the chamber is sufficiently high, while not so high as to cause leakage.

The coating apparatus of FIG. 8 may be run with coating material being supplied at a desired pressure, depending upon the sealing of the edge 44 of the coating apparatus against the moving substrate. A uniform coating material profile in both the longitudinal and transversal directions will be obtained. The method and apparatus of the invention described above affords the additional substantial advantage over conventional prior art constructions in that no recirculation of the coating material is required. Recirculation associated with conventional arrangements results, for example, in impurities becoming entrained in the coating material as well as foaming of the coating material. The arrangement of the invention does not impose any special requirements regarding viscosity of the coating material. Very thin coating material layers can also be attained utilizing the arrangement of the invention described above.

Figure 9:
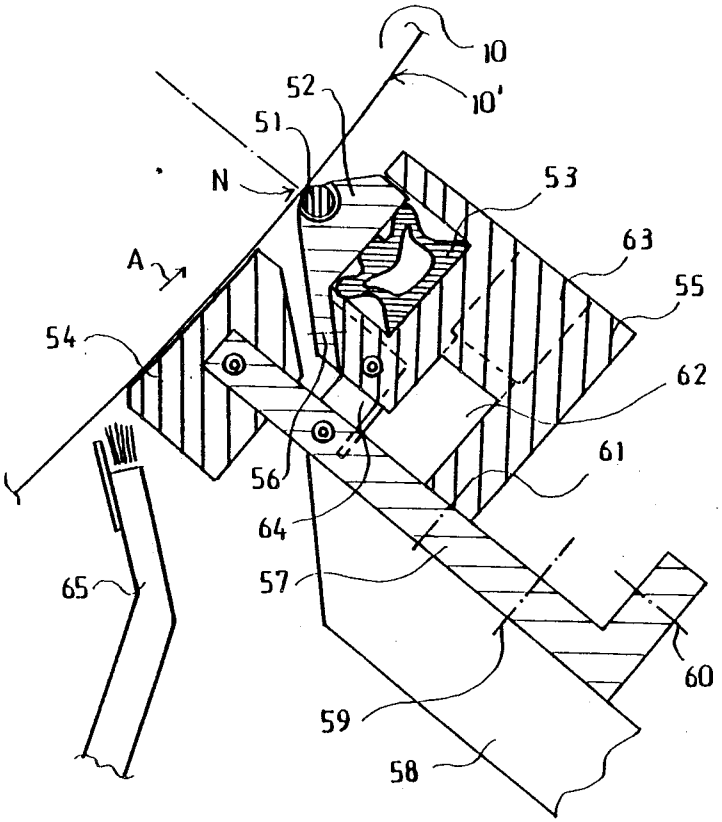
FIGS. 8 and 9 are schematic elevation views in section of two different embodiments of an extruder applied in arrangements in accordance with the invention.

Referring now to FIG. 9, an alternate embodiment of the invention is illustrated. As in the embodiment of FIG. 8, a smoothing member in the form of a coating rod 51 of the type described above is utilized. The coating rod 51 is similarly rotatably mounted in a rod holder 52, preferably formed of suitable plastic material. The rod holder is mounted by suitable fixing elements 56, such as screws, on the frame 55 of the holder. Additionally, the rod holder 52 is carried on frame 55 of the holder with a loading tube 53 interposed between them by means of which the position of the holder 52 relative to the frame 53 can be adjusted. Adjustment is also facilitated by forming the holder 52 of a material having some elasticity, for example, plastic, so that the holder can move sufficiently relative to the frame 55.

The forward edge 56 of the coating apparatus is preferably attached to the frame 57 to which the rod holder frame 55 is rigidly attached by suitable connectors, such as screws 61. Thus, the forward edge 54 and forward edge frame 57 of the coating apparatus, and the coating rod 51, rod holder 52 and holder frame 55, together constitute an integral body which may be moved as an entity towards the moving substrate in order to adjust the position of the forward edge 54 of the coating apparatus. It will therefore be understood that the integral body is mounted on frame 58 of the coating apparatus so as to be moveable towards the moving substrate in order to seal the forward edge 54. The integral body is moved relative to the frame by means of set screws 60, which may comprise micrometer screws, to provide for a fine adjustment of its position. The set screws 60 are therefore used to adjust proper sealing at the forward edge 54 of the coating apparatus. After making this adjustment, the frame 57 of the forward edge is locked by locking screws 59 to a mounting frame 58 of the coating apparatus whereby both the forward edge of the coating apparatus and the frame 55 of the rod holder are fixedly positioned on frame 58 of the coating apparatus. The loading tube 53 may then be used to adjust the pressure of the coating rod 51 against the moving substrate.

A coating material chamber 62 is formed in the frame 55 of the rod holder into which coating material is supplied through entrance ports 63. The coating material is conducted from the coating material chamber 62 through a passage 64 onto the moving substrate, which comprises a surface 10' of the opposing roll 10 in the embodiment illustrated in FIG. 9. The pressure of the coating material supplied into the coating material chamber 62 is measured and adjusted in the same manner as described in connection with FIG. 8. The apparatus illustrated in FIG. 9 also includes fluid, e.g., air or water, jet nozzles 65 by which fluid is applied onto the apparatus and surface to be coated before the forward edge 54. All of the characteristics and advantages described in connection with the embodiment of FIG. 8 are also obtained in the embodiment of FIG. 9. These embodiments are also provided with conventional end seals (not shown) for preventing transverse leakage during operation.

Excessive or insufficient quantities of coating material, frequently associated with conventional coating procedures, cause patchiness in the coating. Moreover, dirt entrained in the coating material causes streaks and other defects in the coating. Furthermore, defects such as depressions in the roll surface will be reproduced as faults in the coating material quantity. For these reasons, the invention also comprises an arrangement for measuring the coating quantity of the roll surface. Patchiness, and other defects, can be measured on the roll surface using a traversing gloss meter. For example, the coating material quantity can be measured by means of x-ray fluorescence techniques, based either on absorption or fluorescence. In the first case, a suitable element is provided on the roll surface which emits x-ray fluorescence radiation of sufficient power. The thickness of the coating material quantity may then be ascertained using fluorescence detectors. Feedback signals are transmitted from the detectors to the coating material feed apparatus and to the pressure control apparatus for adjusting the feed rate and pressure on the basis of the results of the measurements. In this manner, precise coating material quantities are provided in accordance with the invention. The invention may therefore also be applied in high speed pigment coating, i.e., at speeds over 1000 m/min. Various sizing agents having a desired dry matter content may also be used in the coating procedures in accordance with the invention.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a method for dispensing coating material on a surface of a moving substrate wherein said coating material is introduced in coating means before a coating nip and applied directly on said substrate surface through a slit of said coating means to form a coating layer, an improvement comprising the steps of:

providing a coating material smoothing member constituting a component of said coating means, supporting said smoothing member directly against said moving substrate, measuring the quantity of coating material supplied into said moving substrate and deriving a set-point value based on said measurements; and adjusting the rate at which coating material is introduced into said coating means based on said set-point value; and wherein a surface of said smoothing member and said moving substrate surface together define a free flow aperture of said slit.

2. The method of claim 1 wherein said measuring step comprises the step of measuring the quantity of coating material by an x-ray fluorescence technique based on the absorption of fluorescence by said coating material.

3. The apparatus of claim 1 wherein said smoothing member comprises a coating doctor and wherein said supporting structure comprises protuberances arranged on said coating doctor in a plurality of transversely extending rows which are offset with respect to each other in consecutive rows in the direction of travel of said moving substrate.

4. The apparatus of claim 1 wherein said smoothing member comprises a rotatable coating rod and wherein said supporting structure comprises a plurality of protuberances provided on the surface of said rotatable coating rod.

5. Apparatus for dispensing coating material on a surface of a moving substrate comprising:

a coating material smoothing member including a supporting structure, said coating material smoothing member being carried directly against said moving substrate by said supporting structure at a region of support;

said moving substrate and coating material smoothing member defining a slit for dispensing coating material directly onto said moving substrate;

wherein said coating material smoothing member comprises a coating doctor having a tip, wherein said smoothing member is pivotable about said region of support, wherein said supporting structure of said smoothing member has interstices in the transverse or cross machine direction to define flow apertures for the coating material between portions of said support structure which are carried directly against said moving substrate, and wherein said supporting structure comprises a supporting blade including a tip having an undulating shape defining ridges carried directly against said moving substrate and notches defined between said ridges.

6. The apparatus of claim 5 wherein said supporting structure is carried against said moving substrate to form a small angle therewith.

7. The apparatus of claim 6 wherein said angle is substantially zero degrees.

* * * * *